US008187425B2

(12) United States Patent
Bylander et al.

(10) Patent No.: US 8,187,425 B2
(45) Date of Patent: May 29, 2012

(54) APPARATUS FOR WASHING AND DEWATERING PULP

(75) Inventors: Johan Bylander, Sundsvall (SE); Fredrik Pontén, Sundsvall (SE); Jörgen Lundberg, Sundsvall (SE)

(73) Assignee: Metso Paper, Inc. (FI)

( * ) Notice: Subject to any disclaimer, the term of this patent is extended or adjusted under 35 U.S.C. 154(b) by 61 days.

(21) Appl. No.: 12/747,568

(22) PCT Filed: Dec. 11, 2008

(86) PCT No.: PCT/SE2008/051440

§ 371 (c)(1),
(2), (4) Date: Jun. 11, 2010

(87) PCT Pub. No.: WO2009/075642

PCT Pub. Date: Jun. 18, 2009

(65) Prior Publication Data

US 2010/0269997 A1 Oct. 28, 2010

(30) Foreign Application Priority Data

Dec. 13, 2007 (SE) ..... 0750010

(51) Int. Cl.
*D21F 1/00* (2006.01)
*B30B 9/06* (2006.01)

(52) U.S. Cl. ..... 162/232; 162/60; 100/37; 100/74; 100/121; 100/131; 100/132; 210/404

(58) Field of Classification Search ..... 162/60, 162/232; 100/37, 74, 121, 131, 132; 210/404
See application file for complete search history.

(56) References Cited

U.S. PATENT DOCUMENTS

| | | | | |
|---|---|---|---|---|
| 3,772,144 | A | 11/1973 | Luthi et al. | |
| 3,980,518 | A | 9/1976 | Ljung et al. | |
| 5,063,840 | A | 11/1991 | Vote | |
| 5,488,900 | A | 2/1996 | Sundqvist | |
| 6,311,849 | B1 | 11/2001 | Sbaschnigg et al. | |
| 6,521,094 | B2 * | 2/2003 | Lamas et al. | 162/323 |

FOREIGN PATENT DOCUMENTS

| | | | |
|---|---|---|---|
| EP | 1035250 | A2 | 9/2000 |
| EP | 1229164 | A2 | 8/2002 |
| SE | 380300 | B | 11/1975 |
| SE | 501799 | C2 | 5/1995 |
| SE | 512753 | C2 | 5/2000 |

OTHER PUBLICATIONS

International Search Report, PCT/SE2008/051440, dated Mar. 10, 2009.

* cited by examiner

*Primary Examiner* — Eric Hug
*Assistant Examiner* — Peter Chin
(74) *Attorney, Agent, or Firm* — Lerner, David, Littenberg, Krumholz & Mentlik, LLP

(57) ABSTRACT

Apparatus for washing and dewatering pulp including a pair of rotatable press rolls with a permeable outer surface in a casing including a vat in which the press rolls are installed is provided. A gap is provided between the vat and the press rolls as well as means for feeding the pulp into the gap between the rolls and the vat includes a first segment partially enclosing the first roll and a second segment partially enclosing the second roll, and casing members for each segment are pivotable about axes of rotation to open and close the casing, and the distance between the axes of rotation is less than the sum of the outer diameter of the two press rolls.

12 Claims, 2 Drawing Sheets

APPARATUS FOR WASHING AND DEWATERING PULP

CROSS-REFERENCE TO RELATED APPLICATIONS

The present application is a national phase entry under 35 U.S.C. §371 of International Application No. PCT/SE2008/051440 filed Dec. 11, 2008, published in English, which claims priority from Swedish Patent Application No. 0750010-1 filed Dec. 13, 2007, all of which are incorporated herein by reference.

FIELD OF THE INVENTION

The present invention relates to apparatus for washing and dewatering pulp, especially cellulose-containing pulp, comprising two rotatable press rolls having a permeable outer surface, between which the pulp is pressed, and a casing comprising a vat in which the press rolls are installed. The vat partly encloses the outer surface of each press roll and the vat comprises a first side vat segment which partly encloses the outer surface of the first press roll and a second side vat segment which partly encloses the outer surface of the second press roll. The casing comprising a first side casing member provided with the first side vat segment, and a second side casing member provided with the second side vat segment.

BACKGROUND OF THE INVENTION

When producing cellulose-based products, a roll press is frequently used for washing and dewatering the cellulose-based pulp. The pulp is passed between two cooperating press rolls installed in the roll press, the press rolls having a perforated outer surface, a so called mantle surface, whereby the outer surface is permeable to liquid pressed out of the pulp, and the pulp is pressed in the roll nip, or the press nip, between the press rolls, whereby liquid is pressed out of the pulp. The roll press also includes one or more washing zones upstream of the press nip. One example of such a roll press is disclosed in U.S. Pat. No. 3,980,518, in which the central axes of the press rolls lie in substantially the same horizontal plane, and the pulp passes through the press nip between the press rolls in a vertical direction, from below upwards.

The above-mentioned roll presses comprise a vat in which the two press rolls are installed and partially enclosed. The vat limits accessibility to the press roll, especially if the vat encloses a large portion of the circumference of the perforated outer surface of the press roll. Accessibility to the press roll, however, is necessary for performing maintenance work, cleaning the press roll and the press nip, e.g. clearing plugs and removing pulp jammed on the perforated outer surface or in proximity to the press roll, or for changing press rolls. U.S. Pat. No. 5,063,840 discloses several previously known solutions for providing accessibility to the press rolls and the press nip. In one known solution, the vat is provided with a number of small-sized vat access doors. In another known solution, a bottom door is provided, and the nip wedge, which converges towards the press nip, is an integral part of the bottom door. The bottom door is supported by a hoist cylinder and is movable in a vertical direction. However, the access provided by these previously known solutions is limited, and these doors do not provide sufficient working room for clearing plugs. To overcome these drawbacks, U.S. Pat. No. 5,063,840 suggests a solution where the vat is equipped with a bottom door having a nip wedge as an integral part, which bottom door is pivotally mounted by means of a hinge, whereby accessibility is increased.

The use of a vat having pivotable vat segments is also disclosed in U.S. Pat. No. 6,311,849 which describes an apparatus for dewatering and washing pulp, comprising two press rolls, between which the pulp is passed, the axes of rotation of the press rolls lying in a horizontal plane. The vat of this apparatus comprises two upper pivotable vat segments which can be folded upwards for providing better accessibility when performing maintenance work, especially when changing rolls. In this apparatus, the pulp is distributed on the press roll at the lowest position of the circumference of the outer surface.

Further, European Patent No. 1,035,250 describes apparatus for washing and dewatering pulp comprising two filter drums arranged to rotate in opposite directions to create a press nip. The filter drums are installed in a vat which comprises two pivotable upper vat segments for providing access to the filter drums. A gap is formed between the vat and the outer surface of the filter drums, in which gap the pulp is fed while being pressed and washed.

However, accessibility is still limited in these prior art solutions, especially when making inspections, changing press rolls, removing plugs, and cleaning the perforated outer surface or the region in proximity to the outer surface of the press roll, or the press nip.

One object of the present invention is thus to provide apparatus for washing and dewatering pulp which provides improved accessibility when performing maintenance work.

SUMMARY OF THE INVENTION

In accordance with the present invention, this and other objects have now been realized by the invention of apparatus for washing and dewatering pulp comprising first and second rotatable press rolls including first and second outer radii and first and second outer diameters, respectively, each of the first and second rotatable press rolls having a permeable outer surface, and a casing comprising a vat in which the first and second rotatable press rolls are installed, thereby providing a gap between the vat and the permeable outer surfaces of the first and second rotatable press rolls, the first and second rotatable press rolls being juxtaposed with each other defining a press nip therebetween, whereby the pulp is pressed in the press nip, feed means for feeding the pulp into the gap in the direction of rotation of the first and second rotatable press rolls towards the press nip, the vat partially enclosing the permeable outer surfaces of each of the first and second rotatable press rolls and comprising a first side vat segment partially enclosing the permeable outer surface of the first rotatable press roll and a second side vat segment partially enclosing the permeable outer surface of the second rotatable press roll, the casing further comprising a first side casing member provided with the first side vat segment and a second side casing member provided with the second side vat segment, the first side casing member being pivotable about a first axis of rotation between a closed position and an open position for providing access to the first rotatable press roll in the open position, and the second side casing member being pivotable about a second axis of rotation between a closed position and an open position for providing access to the second rotatable press roll in the open position, the distance between the first axis of rotation and the second axis of rotation being less than the sum of the outer diameter of the first rotatable press roll and the outer diameter of the second rotatable press roll. In a preferred embodiment, the distance between the first axis of rotation and the second axis of rotation is less than the sum of the outer radius of the first rotatable press roll and the outer diameter of the second rotatable press roll, wherein the outer diameter of the first rotatable press roll is at least equal to the outer diameter of the second rotatable press roll. In accordance with a preferred embodiment, the distance between the first axis of rotation and the second axis of rotation is less than the sum of the outer radius of the first rotatable press roll and the outer radius of the second rotatable press roll.

In accordance with a preferred embodiment of the apparatus of the present invention, the first side vat segment partially encloses the permeable outer surface of the first rotatable press roll from an inner longitudinal end proximate to the first axis of rotation and an outer longitudinal end distal from the first axis of rotation, and wherein the inner and outer longitudinal ends of the first side vat segment and the first axis of rotation generally lie in a common first plane, and wherein the second side vat segment partially encloses the permeable outer surface of the second rotatable press roll from an inner longitudinal end proximate to the second axis of rotation and an outer longitudinal end distal from the second axis of rotation, and wherein the inner and outer longitudinal ends of the second side vat segment and the second axis of rotation generally lie in a common second plane.

In accordance with one embodiment of the apparatus of the present invention, the first axis of rotation and the second axis of rotation are positioned below the first and second rotatable press rolls, respectively.

In accordance with another embodiment of the apparatus of the present invention, the apparatus includes a stationary base unit, and the first and second side casing members are pivotably mounted to the stationary base unit at the first and second axes of rotation, respectively.

In accordance with another embodiment of the apparatus of the present invention, the first side vat segment is adapted to encompass more than 150° of the outer circumference of the first rotatable press roll and the second side vat segment is adapted to encompass more than 150° of the outer circumference of the second rotatable press roll.

In accordance with another embodiment of the apparatus of the present invention, the first side casing member includes at least a first arm and the second side casing member includes at least a second arm, the at least first and second arms each including first and second locking members adapted to detachably attach the first and second arms to a complementary locking member to lock each of side casing members in the closed position, wherein the distance between the first and second locking members when the side casings are in the closed positions is less than the sum of the outer radius of the first rotatable press roll and the outer diameter of the second rotatable press roll, wherein the outer diameter of the first rotatable press roll is at least equal to the outer diameter of the second rotatable press roll. In a preferred embodiment, the apparatus includes at least two sets of the at least first and second arms.

In accordance with another embodiment of the apparatus of the present invention, the distance between the first and second locking members when the side casing members are in the closed positions is at most equal to the sum of the outer radius of the first rotatable press roll and the outer radius of the second rotatable press roll.

In accordance with another embodiment of the apparatus of the present invention, the apparatus comprises a stationary central member including first and second complementary locking members detachably attachable to the first and second locking members, respectively.

In accordance with another embodiment of the apparatus of the present invention, the first and second locking members of the first arm and the first and second locking members of the second arm are detachably attachable to each other for locking each of the side casing members in the closed position. In a preferred embodiment, the apparatus includes a locking device mounted to the first arm and adapted to control the locking means of the first arm. Preferably, the locking device is adapted to be remotely controlled.

In accordance with the present invention, where there is a small distance between the axes of rotation of the side casing members, it is possible to design the side casing members so that the vat segments of the side casing members can cover more of the outer surface of the press rolls, whereby improved accessibility to the press rolls is provided for performing maintenance work, when the side casing members are positioned in their opened and non-operating position.

Advantageously, the axes of rotation of the press rolls are in substantially the same horizontal plane.

According to an advantageous embodiment of the apparatus according to the present invention, the distance between the first axis of rotation and the second axis of rotation is less than the sum of the outer radius of the first press roll and the outer diameter of the second press roll, where the outer diameter of the first press roll is greater than or equal to the outer diameter of the second press roll. In this manner, it is now possible to design the side casing members so that the side vat segments can cover even more of the outer surface of the press rolls, providing improved accessibility to the press rolls, when the side casing members are positioned in their opened and non-operating position. Further, according to this embodiment, the side vat segment can cover a large portion of the outer surface of the press roll and at the same time the movement of the longitudinal edge of the side vat segment, which is closest to the axis of rotation, towards the outer surface of the press roll, when opening the side casing member, can be kept acceptably small, whereby the risk of pulp getting jammed between the longitudinal edge of the side vat segment and the outer surface of the press roll, when opening the side casing member, is reduced. This jammed pulp can prevent the side casing member from being opened, or it can damage the longitudinal edge of the side vat segment or the outer surface of the press roll. Since there is a gap between the side vat segment and the outer surface of the press roll, the apparatus can allow a certain movement of the longitudinal edge towards the outer surface of the press rolls without contact between said longitudinal edge and the press roll surface.

According to a further advantageous embodiment of the apparatus according to the present invention, the distance between the first axis of rotation and the second axis of rotation is less than the sum of the outer radius of the first press roll and the outer radius of the second press roll. In this manner, it is now possible to design the side casing members so that the side vat segments can cover even more of the outer surface of the press rolls, providing further improved accessibility to the press rolls, when the side casing members are positioned in their opened and non-operating position. Further, the side vat segment can cover an even larger portion of the outer surface of the press roll and at the same time movement of the longitudinal edge of the side vat segment, which is closest to the axis of rotation, towards the outer surface of the press roll, when opening the side casing member, can be kept acceptably small, whereby the above-mentioned risk of pulp getting jammed is kept at a minimum.

According to another advantageous embodiment of the apparatus according to the present invention, the longitudinal edges of the first side vat segment and the first axis of rotation generally lie in a common first plane, and the longitudinal edges of the second side vat segment and the second axis of rotation generally lie in a common second plane. Advantageously, the axis of rotation of the first press roll also generally lies in the first plane, and the axis of rotation of the second press roll generally lies in the second plane. In this manner, it is possible to design the side casing members so that the side vat segments can cover still more of the outer surface of the press rolls, since both longitudinal edges of each side vat segment will be moved away from the outer surface of the press roll, without moving towards the outer surface of the press roll, when the side casing member is opened. Thus, the above-mentioned risk of pulp getting jammed when opening the side casing member, is eliminated.

The first axis of rotation could even be substantially aligned with the second axis of rotation.

According to another advantageous embodiment of the apparatus according to the present invention, the first axis of rotation and the second axis of rotation are positioned below the first and second press rolls.

According to yet another advantageous embodiment of the apparatus according to the present invention, the apparatus comprises a stationary base unit, and the first and second side casing members are pivotally mounted to the base unit through their respective axes of rotation. In a prior art apparatus of the type disclosed in European Patent No. 1,035,250, the pivotable side casing members are pivotally mounted to different beams which are mounted at respective longitudinal side of the apparatus. These two beams are anchored to the end constructions of the casing or frame. The dimensions and weight of the beams and the ends of the casing must be great so that the side casing members can withstand the great forces acting on the side casing members, which forces originate from the internal overpressure produced within the vat during operation. Large and heavy constructions are expensive to produce, and difficult to transport and install. By pivotally mounting the side casing members to one and the same base unit, the forces acting on the side casing members are balanced, i.e. the forces acting on the first side casing member are counterbalanced by the forces acting on the second side casing member, and the casing and frame of the apparatus can be produced using less material, whereby the weight of the apparatus is lower, and the apparatus is therefore easier to transport and install, and also less expensive to produce.

According to an advantageous embodiment of the apparatus according to the present invention, the first side vat segment is adapted to enclose more than 150° of the outer surface circumference of the first press roll, and the second side vat segment is adapted to enclose more than 150° of the outer surface circumference of the second press roll. Advantageously, each side vat segment is adapted to enclose 170° to 180° of the outer surface circumference of the respective press roll.

By designing side casing members so that the side vat segments enclose a larger portion of the surface of the outer circumference of each press roll, there is no need for a central casing member which is movable in a vertical direction to provide access to the press rolls. Exclusion of the movable central casing member and the presence of only two movable casing members, reduces the amount of sealing surfaces and reduces the manufacturing costs of the apparatus.

Further, by means of the stationary base unit being positioned substantially below the first and second press rolls, the apparatus can rest directly on the floor, and no space for receiving a lowered central casing member beneath the apparatus is necessary, whereby the apparatus according to the present invention is less bulky and does not require as large an installation space as prior art apparatus.

According to a further advantageous embodiment of the apparatus according to the present invention, the apparatus comprises at least one set of arms, each set comprising a first arm and a second arm, where the first side casing member is provided with the first arm and the second side casing member is provided with the second arm, where each arm is provided with locking means for detachably attaching to a complementary locking means to lock the side casing member in its closed position, the distance between the locking means of the first and second arms of a set, when the side casing members are in their respective closed positions, being less than the sum of the outer radius of the first press roll and the outer diameter of the second press roll, where the outer diameter of the first press roll is greater than or equal to the outer diameter of the second press roll.

These positions of the locking means of the first and second arms efficiently supports the side casing members to withstand the forces acting on the side casing members, which forces originate from the internal overpressure produced within the vat during operation. By this arrangement for locking the side casing members above the press rolls in combination with the inventive positions of the axes of rotation of the side casing members, strong and resistant side casing members are provided, and at the same time, the casing and frame of the apparatus can be produced using less material, whereby the weight of the apparatus is lower and therefore the apparatus is easier to transport and install, and also less expensive to produce. Advantageously, the distance between the locking means of the first and second arms of a set, when the side casing members are in their respective closed position, can be equal to or less than the sum of the outer radius of the first press roll and the outer radius of the second press roll.

Further advantageous embodiments of the apparatus according to the present invention emerge from the dependent claims and the detailed description of preferred embodiments.

BRIEF DESCRIPTION OF THE DRAWINGS

The present invention will now be described, for exemplary purposes, in more detail with reference to the following detailed description with reference to the enclosed drawings, in which.

DETAILED DESCRIPTION

Figure 1:
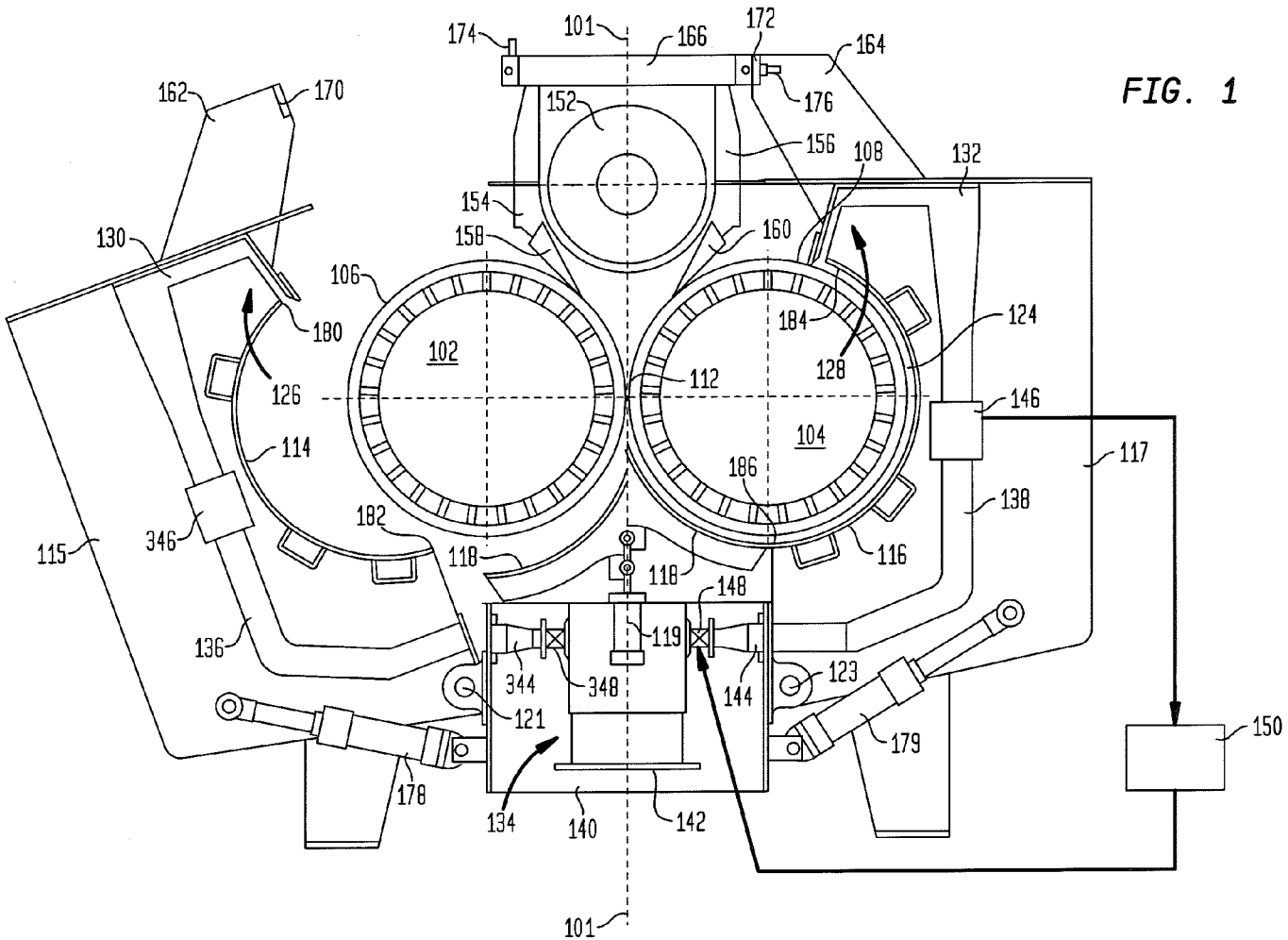
FIG. 1 is a side, elevational, schematic view of an embodiment of the apparatus according to the present invention.

FIG. 1 shows an embodiment of the apparatus for washing and dewatering cellulose-containing pulp according to the present invention. The apparatus has a substantially symmetrical configuration with regard to a symmetry plane 101, and in FIG. 1, the left side of the apparatus, i.e. to the left of the symmetry plane 101, illustrates the apparatus in an opened position, whereas the right side of the apparatus, i.e. to the right of the symmetry plane 101, illustrates the apparatus in a closed and operating position. The apparatus comprises a first rotatable press roll 102 on the left side of the apparatus and a second rotatable press roll 104 on the right side of the apparatus, each press roll, 102 and 104, having a permeable outer surface 106, 108. The outer surface, 106 and 108, are perforated, i.e. provided with apertures, whereby the outer surface, 106 and 108, are permeable to filtrate pressed out of the pulp. The shape of the apertures is normally circular, but any shape is possible. The press rolls, 102 and 104, comprise a number of filtrate channels radially inwards of the outer surface, 106 and 108, to lead evacuated filtrate away. The two press rolls defines a press nip 112 between them, in which press nip the pulp is pressed, and are arranged to rotate in opposite directions, the left press roll 102 being arranged to rotate in counter clockwise direction and the right press roll 104 being arranged to rotate in a clockwise direction. In this embodiment, the axes of rotation of the press rolls, 102 and 104, are in substantially the same horizontal plane, and the apparatus is arranged to feed the pulp through the press nip 112 in a substantially vertical direction from below upwards. However, other positions of the press rolls, 102 and 104, in relation to each other are possible, and the pulp can be fed through the press nip 112 in other directions. The press rolls 102, 104 are adjustable in relation to each other, whereby the press nip 112 is adjustable.

The apparatus comprises a casing which includes a vat, 114, 116, and 118, in which the press rolls, 102 and 104, are installed, the vat, 114, 116, and 118, partly enclosing the outer surface, 106 and 108, of each press roll, 102 and 104, whereby a gap 124 for each press roll, 102 and 104, is defined, limited by the vat, 114, 116, and 118, and the outer surface, 106 and 108, of the respective press roll, 102 and 104. The vat, 114, 116, and 118, comprises a first side vat segment 114 which partly encloses the outer surface 106 of the first press roll 102, and a second side vat segment 116 which partly encloses the outer surface 108 of the second press roll 104.

the casing comprises a first side casing member 115 which extends between the ends of the first press roll 102 and to which the first side vat segment 114 is mounted, and a second side casing member 117 which extends between the ends of the second press roll 104 and to which the second side vat segment 116 is mounted. The side vat segment, 114 and 116, can be mounted to the side casing member, 115 and 117, in different ways, or the side vat segment, 114 and 116, can be integrally formed with its side casing member, 115 and 117. The first side casing members 115 is pivotable about a first axle 121 forming a first axis of rotation 121, and the second side casing members 117 is pivotable about a second rotation axle 123 forming a second axis of rotation 123, whereby the side casing members, 115 and 117, together with their side vat segments, 114 and 116, are movable between a closed position and an opened position for providing access to the press rolls, 102 and 104. The first axis of rotation 121 and the second axis of rotation 123 are substantially parallel to each other. In FIG. 1, on the left side of the apparatus, the first side casing member 115 is in an opened position, whereby access to the press roll 102 is provided, whereas on the right side of the apparatus, the second side casing member 117 is in a closed and operating position.

Further, the vat, 114, 116, and 118, comprises a central vat segment 118 partly enclosing the outer surface 106, 108 of the press rolls, 102 and 104, between the press nip 112 and the side vat segments, 114 and 116. The central vat segment 118 is movable in a substantially vertical direction for providing additional accessibility to the region in proximity to the press nip 112. In FIG. 1, on the left side of the apparatus, the central vat segment 118 is shown in an opened position, whereas on the right side of the apparatus, the central vat segment 118 is shown in a closed and operating position.

As mentioned above, a gap 124 is formed between the vat, 114, 116, and 118, and the outer surface, 106 and 108, of the press rolls, 102 and 104. In FIG. 1, only the right side of the apparatus illustrated the apparatus in a closed and operating position, and thus, only the gap 124 with regard to the second press roll 104 and the vat, 116 and 118, is shown, whereas the gap with regard to the first press roll 102 and the vat, 114 and 118, is not present in FIG. 1. However, when the left side of the apparatus is in a corresponding closed and operating position, a corresponding gap is provided between the first press roll 102 and the vat, 114 and 118.

The apparatus comprises a first pulp distribution device 126 for distributing pulp onto the first press roll 102 and a second pulp distribution device 128 for distributing pulp onto the second press roll 104. The pulp distribution devices 126, 128 are arranged to distribute pulp to the gap 124 along the whole length of each press roll, 102 and 104. The pulp distributed on the outer surfaces, 106 and 108, of the press roll, 102 and 104, forms a mat on the press rolls, 102 and 104. From the pulp distribution devices, 126 and 128, to the press nip 112, the pulp is fed in the gap 124 in the direction of rotation of the press rolls, 102 and 104, while being pressed, or pressed and washed.

The first pulp distribution device 126 is mounted on the first side casing member 115, and the second pulp distribution device 128 is mounted on the second side casing member 117, whereby each pulp distribution device, 126 and 128, is moved away from the respective press roll 102, 104 when its side casing member, 115 and 117, is opened and moved away from the respective press roll, 102 and 104, providing an improved accessibility. In this manner, the pulp distribution device, 126 and 128, comprise a forming unit, 130 and 132, for forming the pulp prior to distribution on the press roll, 102 and 104. However, other kinds of pulp distribution devices are possible, such as pulp distribution screws etc. The pulp distribution device, 126 and 128, can also comprise several separate pulp distribution units distributed one after the other along the longitudinal extension of the press roll 102, 104.

Further, the apparatus is provided with an inlet device 134 for receiving pulp to the apparatus, and several flow channels, 136 and 138, for transporting pulp from the inlet device 134 to the pulp distribution devices, 126 and 128, which flow channels, 136 and 138, are mounted to and integrated with the side casing members, 115 and 117. The flow channels, 136 and 138, can be positioned on the outside of the side casing members, 115 and 117 and mounted to them, or positioned integrally inside the side casing members, 115 and 117. In this manner, the flow channels are in the form of pipes having a substantially circular cross-section, however, other designs are possible. The inlet device 134 is housed in a stationary base unit 140 positioned substantially below the first and second press rolls, 102 and 104. The inlet device includes an inlet 142 for connection to an external pulp supply, and an outlet means, 346 and 144, for each flow channel, 136 and 138, which outlet means, 346 and 144, is located in the base unit 140 and is connectable to its flow channel, 136 and 138, when the side casing member, 115 and 117, is in a closed position. The apparatus has sealing means for sealing the passage, from the outlet means, 344 and 144, to the flow channel, 136 and 138, between the outlet means, 344 and 144, and the flow channel, 136 and 138. The apparatus is provided with a flow meter, 346 and 146, for measuring the flow rate of the pulp flow in the flow channel 136, 138, and the outlet means, 344 and 144, comprises a valve, 348 and 148, for controlling the flow of pulp to the flow channel 138. The apparatus comprises a control device 150 for controlling the valve, 348 and 148, based on the input of the flow meter, 346 and 146.

Each side casing member, 115 and 117, is pivotally mounted to the base unit 140 by means of their respective axle, 121 and 123. Each side casing member, 115 and 117, is also connected to the base unit 140 by means of a respective hydraulic cylinder, 178 and 179, for controlling the movement of the respective side casing member, 115 and 117. The central vat segment 118 is also movably attached to the base unit 140 by means of a hydraulic cylinder 119 for controlling the movement of the central vat segment 118. The centre-to-centre distance between the first axle 121 and the second axle 123 is approximately equal to the sum of the outer radius of the first press roll 102 and the outer radius of the second press roll 104, and thus this center-to-center distance is less than the sum of the outer diameter of the first press roll 102 and the outer diameter of the second press roll 104. The first side vat segment 114 is adapted to enclose about 175° of the outer surface of the circumference of the first press roll 102, and the second side vat segment 116 is adapted to enclose about 175° of the outer surface of the circumference of the second press roll 104. Advantageously, each side vat segment, 114 and 116, is adapted to enclose 170° to 180° of the outer surface of the circumference of the respective press rolls, 102 and 104.

In operation, the central vat segment 118 is internal in relation to the external casing formed by the side casing members, 115 and 117, the base unit 140 and two stationary end casing members of the apparatus, i.e. the two gables of the apparatus. By the base unit 140 and the side casing members, 115 and 117, of the present invention, the amount of sealing surfaces are reduced compared to the prior art, since there are only sealing surfaces between the two moving side casing members, 115 and 117, the two gables, and the base unit 140, in the present invention, whereas in prior art apparatus having two movable external central casing members, thus four external movable casing members, more sealing is required.

The apparatus also includes a pulp transport screw 152, which for example can be in the form of a pulp disintegrating screw or a shredder screw, towards which the pulp which has been pressed in the press nip 112 is conveyed. The pulp transport screw 152 extends in parallel to the longitudinal axes of the press rolls, 102 and 104, and is arranged to disintegrate the pulp and transport the pulp axially away from the press for further processing. Each press roll, 102 and 104, is provided with a respective doctor bar, 154 and 156, and each doctor bar, 154 and 156, is provided at the bottom thereof with a respective doctor blade, 158 and 160, for scraping the outer surface, 106 and 108, of the respective press roll, 102 and 104.

The apparatus comprises two sets of arms, 162 and 164 (only one set shown in FIG. 1). Each set comprising a first arm 162 and a second arm 164, where the first side casing member 115 is provided with the first arm 162 and the second side casing member 117 is provided with the second arm 164. Each arm, 162 and 164, is provided with a locking means, 170 and 172, in the form of a recess, adapted to be detachably attached to a complementary locking means, 174 and 176, in the form of a bolt, for locking the side casing member, 115 and 117, in its closed position. The complementary locking means, 174 and 176, are pivotally anchored to a stationary central member 166 of the apparatus, which central member 166 is positioned above the press rolls, 102 and 104. The stationary central member 166 is positioned above the pulp transport screw 152.

The distance between the locking means, 170 and 172, of the first and second arms, 162 and 164, of a set, when the side casing members, 115 and 117, are in their respective closed position, is approximately equal to the sum of the outer radius of the first press roll 102 and the outer radius of the second press roll 104, and thus less than the sum of the outer radius of the first press roll 102 and the outer diameter of the second press roll 104, where the outer diameter of the first press roll 102 is substantially equal to the outer diameter of the second press roll 104.

Figure 2:
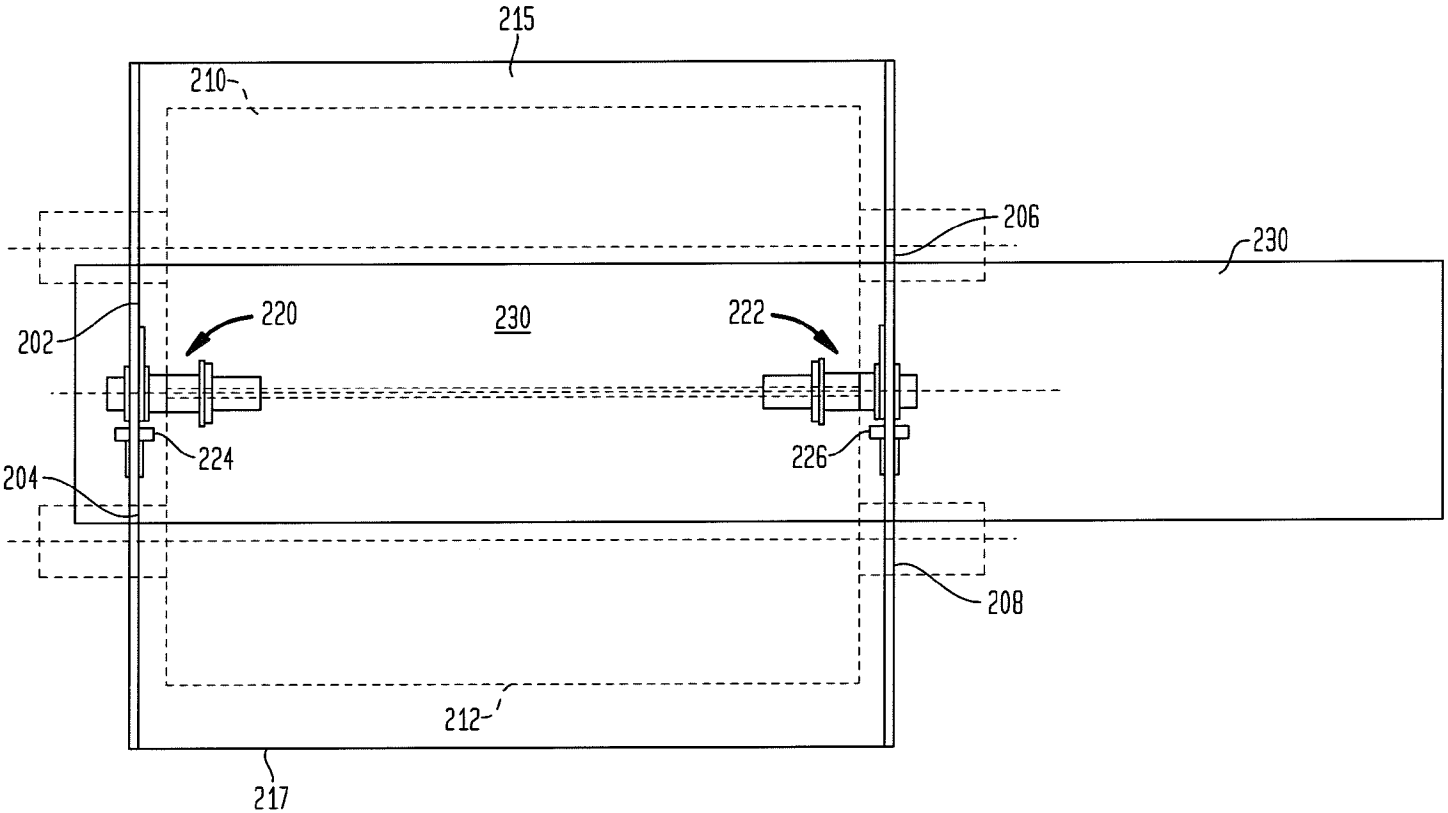
FIG. 2 is a top, elevational, schematic view of a second embodiment of the apparatus according to the present invention.

FIG. 2 shows a second embodiment of the apparatus for washing and dewatering cellulose-containing pulp according to the present invention, where two sets of arms, 202, 204, 206, and 208, are shown positioned by the ends of the press rolls, 210 and 212, and mounted at ends of the side casing members, 215 and 217. In this embodiment, the locking means, 220 and 222, of a set's first arm, 202 and 206, and the locking means, 224 and 226, of the same set's second arm, 204 and 208, are detachably attachable to each other above the pulp transport screw for locking the side casing members, 215 and 217, in their respective closed positions. A remote-controlled lock device includes the locking means, 220 and 222, of a set's first arm, 202 and 206, which lock device is mounted to a set's first arm 202 and 206, and adapted to control the locking means, 220 and 222, of a set's first arm, 202 and 206. In this manner, the operator can safely unlock the side casing members, 215 and 217, from a distance, and the risk of being exposed to hot pulp or filtrate when unlocking the side casing members, 215 and 217, is thus eliminated. Further, the time needed for locking and unlocking of the side casing members, 215 and 217, is radically reduced. The locking means, 220 and 222, of the set's first arm, 202 and 206, can for example include a movable member which is adapted to engage a recess of the locking means, 224 and 226, of the set's second arm, 204 and 208, for locking the side casing members, 215 and 217, in their respective closed position. In this embodiment, the distance between the locking means, 220, 222, 224, and 226, of the first and second arms, 202, 204, 206, and 208, of a set is minimal. Above the press rolls, 210 and 212, and between the side casing members, 215 and 217, is a top housing 230 provided, which top housing 230 also extends outside the second set of arms, 206 and 208. A pulp transport screw for transporting pulp away from the press nip is installed within this top housing 230.

The first axis of rotation and the second axis of rotation could also be positioned above the first and second press rolls, and the locking of the side casing members, by means of the above-mentioned locking means and arms, could be provided below the first and second press rolls.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Apparatus for washing and dewatering pulp comprising first and second rotatable press rolls including first and second outer radii and first and second outer diameters, respectively, each of said first and second rotatable press rolls having a permeable outer surface, and a casing comprising a vat in which said first and second rotatable press rolls are installed, thereby providing a gap between said vat and said permeable outer surfaces of said first and second rotatable press rolls, said first and second rotatable press rolls being juxtaposed with each other defining a press nip therebetween, whereby said pulp is pressed in said press nip, feed means for feeding said pulp into said gap in the direction of rotation of said first and second rotatable press rolls towards said press nip, said vat partially enclosing said permeable outer surfaces of each of said first and second rotatable press rolls and comprising a first side vat segment arranged to enclose from 170° to 180° of said permeable outer surface of said first rotatable press roll and a second side vat segment arranged to enclose from 170° to 180° of said permeable outer surface of said second rotatable press roll, said casing further comprising a first side casing member provided with said first side vat segment and a second side casing member provided with said second side vat segment, said first side casing member being pivotable about a first axis of rotation between a closed position and an open position for providing access to said first rotatable press roll in said open position, and said second side casing member being pivotable about a second axis of rotation between a closed position and an open position for providing access to said second rotatable press roll in said open position, said first axis of rotation and said second axis of rotation being positioned below said first and second rotatable press rolls, respectively, the distance between said first axis of rotation and said second axis of rotation being less than the sum of said outer diameter of said first rotatable press roll and said outer diameter of said second rotatable press roll.

2. Apparatus according to claim 1 wherein said distance between said first axis of rotation and said second axis of rotation is less than the sum of said outer radius of said first rotatable press roll and said outer diameter of said second rotatable press roll, wherein said outer diameter of said first rotatable press roll is at least equal to said outer diameter of said second rotatable press roll.

3. Apparatus of claim 2 wherein said distance between said first axis of rotation and said second axis of rotation is less than the sum of said outer radius of said first rotatable press roll and said outer radius of said second rotatable press rolls.

4. Apparatus according to claim 3 wherein said first side vat segment partially encloses said permeable outer surface of said first rotatable press roll from an inner longitudinal end proximate to said first axis of rotation and an outer longitudinal end distal from said first axis of rotation, and wherein said inner and outer longitudinal ends of said first side vat segment and said first axis of rotation generally lie in a common first plane, and wherein said second side vat segment partially encloses said permeable outer surface of said second rotatable press roll from an inner longitudinal end proximate to said second axis of rotation and an outer longitudinal end distal from said second axis of rotation, and wherein said inner and outer longitudinal ends of said second side vat segment and said second axis of rotation generally lie in a common second plane.

5. Apparatus according to claim 1 including a stationary base unit, and wherein said first and second side casing members are pivotably mounted to said stationary base unit at said first and second axes of rotation, respectively.

6. Apparatus according to claim 1 wherein said first side casing member includes at least a first arm and said second side casing member includes at least a second arm, said at least first and second arms each including first and second locking members adapted to detachably attach said first and second arms to a complementary locking member to lock each of side casing members in said closed position, wherein the distance between said first and second locking members when said side casings are in said closed positions is less than the sum of the outer radius of said first rotatable press roll and said outer diameter of said second rotatable press roll, wherein said outer diameter of said first rotatable press roll is at least equal to said outer diameter of said second rotatable press roll.

7. Apparatus according to claim 6 comprising at least two sets of said at least first and second arms.

8. Apparatus according to claim 6 wherein said distance between said first and second locking members when said side casing members are in said closed positions is at most equal to the sum of said outer radius of said first rotatable press roll and said outer radius of said second rotatable press roll.

9. Apparatus according to claim 6 comprising a stationary central member including first and second complementary locking members detachably attachable to said first and second locking members, respectively.

10. Apparatus according to claim 6 wherein said first and second locking members of said first arm and said first and second locking members of said second arm are detachably attachable to each other for locking each of said side casing members in said closed position.

11. Apparatus according to claim 10 including a locking device mounted to said first arm and adapted to control said locking means of said first arm.

12. Apparatus according to claim 11 wherein said locking device is adapted to be remote controlled.

* * * * *